US007402077B2

(12) United States Patent
Shindo

(10) Patent No.: US 7,402,077 B2
(45) Date of Patent: Jul. 22, 2008

(54) MULTI-STEP ELECTRIC CONNECTOR

(75) Inventor: Hidehiro Shindo, Tokyo (JP)

(73) Assignee: FCI, Versailles (FR)

( * ) Notice: Subject to any disclaimer, the term of this patent is extended or adjusted under 35 U.S.C. 154(b) by 0 days.

(21) Appl. No.: 10/532,182

(22) PCT Filed: Oct. 24, 2003

(86) PCT No.: PCT/JP03/13625

§ 371 (c)(1),
(2), (4) Date: Nov. 14, 2005

(87) PCT Pub. No.: WO2004/038868

PCT Pub. Date: May 6, 2004

(65) Prior Publication Data

US 2006/0094292 A1 May 4, 2006

(30) Foreign Application Priority Data

Oct. 25, 2002 (JP) ..... 2002-311715

(51) Int. Cl.
*H01R 13/60* (2006.01)

(52) U.S. Cl. ..... 439/541.5

(58) Field of Classification Search ..... 439/541.5, 439/579, 79, 80

See application file for complete search history.

(56) References Cited

U.S. PATENT DOCUMENTS 4,806,109 A 2/1989 Manabe et al. ..... 439/108
6,811,434 B2 * 11/2004 Wu ..... 439/567
7,070,446 B2 * 7/2006 Henry et al. ..... 439/541.5
7,081,011 B2 * 7/2006 Kikuchi et al. ..... 439/541.5

FOREIGN PATENT DOCUMENTS

| | | |
|---|---|---|
| EP | 0 270 598 A1 | 9/1993 |
| JP | 62-285376 | 12/1987 |
| JP | 5-234642 | 9/1993 |
| JP | 7-272798 | 10/1995 |
| JP | 8-255656 | 10/1996 |
| WO | WO87/07444 A1 | 12/1987 |

* cited by examiner

*Primary Examiner*—Phuong Dinh
(74) *Attorney, Agent, or Firm*—Harrington & Smith, PC

(57) ABSTRACT

The differences in length of conductor portions which arise due to differing levels in a two level type electric connector, that is, errors in the impedance characteristics, are improved. The multiple level type electric connector of the present invention is characterized by being provided with a plurality of levels of rows of electric contacts aligned on a same surface, stacked in a direction perpendicular to the aforementioned surfaces, each electric contact row containing electric contacts for signals and electric contacts for grounding, each of the electric contacts for signals contained in each of the electric contact rows having a free end located on a first plane differing for each level, and a leg portion extending downwards from said first plane and leading to a same second plane, and each of the electric contacts for grounding contained in each of the electric contact rows having a free end located on a first plane, and a leg portion extending downwards from said first plane and leading to a same second plane connected to a grounding line, and being provided with a shield portion connected to a grounding line, and at least partially covering the leg portions of the aforementioned electric contacts.

8 Claims, 6 Drawing Sheets

MULTI-STEP ELECTRIC CONNECTOR

TECHNICAL FIELD

The present invention concerns an interface for high-speed communication, and more specifically concerns a connector for an end of a board for connecting a personal computer and a peripheral device.

BACKGROUND ART

In recent years, technical development in electronic device-related fields has been remarkable, and in particular, the improvement of speed in personal computers has been making extraordinary technical advancements. Japanese Unexamined Patent Publication No. 2001-143798 describes, concerning a connector standard (device bay) used for connecting electrically to personal computer peripheral devices, a connector wherein the portions connecting to a board of the leg portions of two levels of electrical contact rows are capable of being grounded along a straight line on a flat plane, and wherein a plurality of electric connector rows are housed while minimizing the size of the connector.

In the two level type electric contact array disclosed in the aforementioned patent publication, the electric contacts of the lower level of the array are signal lines, and each of the electric contacts of the upper level are bus type electric connectors connected by a conductor.

However, as the speed of signal transfer increases, connector standards are also changing. Currently, ATA interfaces are utilized, focused on internal hard disks, for which high speed signal transfer is required, and in the future, it is expected that a serial ATA standard having the objective of replacing the conventional parallel interface with a high-speed serial interface in order to handle the speed increase of interfaces, as well as an increase in hard disk capacity due to a rapid improvement in the recording density of hard disks.

Further, as the interfaces in personal computers increase, many signal lines and grounding lines will be needed. As one method of solving this problem, it is possible to achieve this by stacking rows of the aforementioned signal lines or grounding lines in multiple levels, but for the required signal transfer speeds of several hundred megabytes per second, due to differences in the length of the conductor portion that arises due to the differing levels of the aforementioned rows, a large error arises in the impedance characteristic of the upper level in comparison to the lower level near the board, so the transfer characteristic of the signal becomes non-uniform. As a result, a misalignment of the phase of the transferred signal arises, and the reliability of signal transfer is reduced.

In order to overcome the aforementioned problems, it was hoped for that a connector would be provided that matches the impedance difference arising from the difference in conductor lengths due to the differing levels of the electric contact rows. The desired connector must house a plurality of levels of electric contact rows.

DISCLOSURE OF THE INVENTION

In order to overcome the aforementioned problems, the present applicant discovered that in a system joining a first electronic device and a second electronic device through a cable, the aforementioned impedance can be matched by a connector having a plurality of levels of electric contact rows attached to a board, provided with a shield portion connected to a grounding line, said shield portion at least partially covering the leg portions of the electric contacts for signals.

The electric connector of the present invention is characterized by being provided with a plurality of levels of rows of electric contacts aligned on a same surface, stacked in a direction perpendicular to the aforementioned surfaces, each electric contact row containing electric contacts for signals and electric contacts for grounding, each electric contact for signals contained in each electric contact row having an open end located on a first plane differing for each level, and a leg portion extending downwards from said first plane and leading to a same second plane, each electric contact for grounding contained in each electric contact row having an open end located on a first plane, and a leg portion extending downwards from said first plane and leading to a same second plane connected to a grounding line, and being provided with a shield portion connected to a grounding line, and at least partially covering the leg portions of the aforementioned electric contacts.

The present invention is a configuration effective for a connector having a multiple level type structure under a connector standard called the serial ATA standard which makes high-speed signal transfer possible. When each leg portion of the electric contact rows for signals of each level is connected to a board and the like, differences in length of each of the leg portions due to the differing levels, that is, errors in the impedance characteristics are created. These errors appear more prominently the higher the speed of the signal transferred. However, by having a shield portion connected to a grounding line, which at least partially covers the leg portion of each electric contact for signals, the impedance can be matched, that is, a uniform signal transfer characteristic is obtained and the reliability of signal transfer is improved.

According to another embodiment of the present invention, in the aforementioned electric connector, the aforementioned electric contacts for grounding of at least one of the levels is connected to the aforementioned shield portion.

If the aforementioned electric contacts for grounding of at least one of the levels are connected to the aforementioned shield portion, the electric connector according to the present invention makes integral formation possible, and the leg portions of each of the electric contacts for grounding can be eliminated, and space can be used more efficiently.

According to another embodiment of the present invention, the electric contact array constructed with the aforementioned multiple levels, of the aforementioned electric connector, has a two level configuration.

This embodiment corresponds to the structure of two level type serial ATA connectors and the like.

According to another embodiment of the present invention, the aforementioned shield portion of the aforementioned electric connector is characterized in that it does not cover the leg portions of each of the electric contacts for signals of the lowest level.

For the shape of the aforementioned shield portion, by having a shape that does not cover the leg portions of the electric contacts for signals of the lowest level, the placement of the signal lines can be selected flexibly.

According to another embodiment of the present invention, the aforementioned shield portion of the aforementioned electric connector is characterized by being located above the leg portion of the electric contacts for signals of the lowest level.

If the aforementioned shield portion is located above the leg portion of the electric contacts for signals of the lowest level, the leg portions of each of the electric contacts for signals of each level become free ends below the electric contact row surface of the lowest level, and further, a flexible alignment for the signal lines can be selected.

According to another embodiment of the present invention, the shape and material of the aforementioned shield portion of the aforementioned electric connector is characterized by being determined so that the impedance of each of the electric contacts for signals are substantially identical.

If the shape of the aforementioned shield portion is, for example, shaped in a flat planar form, each of the electric contacts for signals can be covered uniformly, and the impedance error can be made small. Additionally, for the material of the aforementioned shield portion, for example, copper with a high conductivity can be selected.

Another embodiment of the present invention is characterized in that in the aforementioned electric contact row of each level, an electric contact for grounding is provided between each N (N being an integer greater than or equal to 1) successive electric contacts for signals.

The number of electric contacts for signals and electric contacts for grounding arranged in an electric contact row can be selected according to the transfer speed of the signal, and the number of signal lines required.

According to another embodiment of the present invention, the electric connector of the present invention is equipped with a housing capable of housing the aforementioned electric contact rows.

The aforementioned housing can be configured in an arbitrary shape capable of housing electric contacts and at the same time anchor and hold mating electric contacts, and can be made in a shape for which the removing of the connector is done easily.

According to another embodiment of the present invention, the electric connector is mountable on an electric circuit board.

By anchoring the aforementioned housing on one portion of an open end of a board, connection with peripheral devices can be done easily without disassembling a personal computer and the like whereon a board is mounted.

SIMPLE DESCRIPTION OF THE DRAWINGS

EXPLANATION OF THE SYMBOLS

Figure 1:
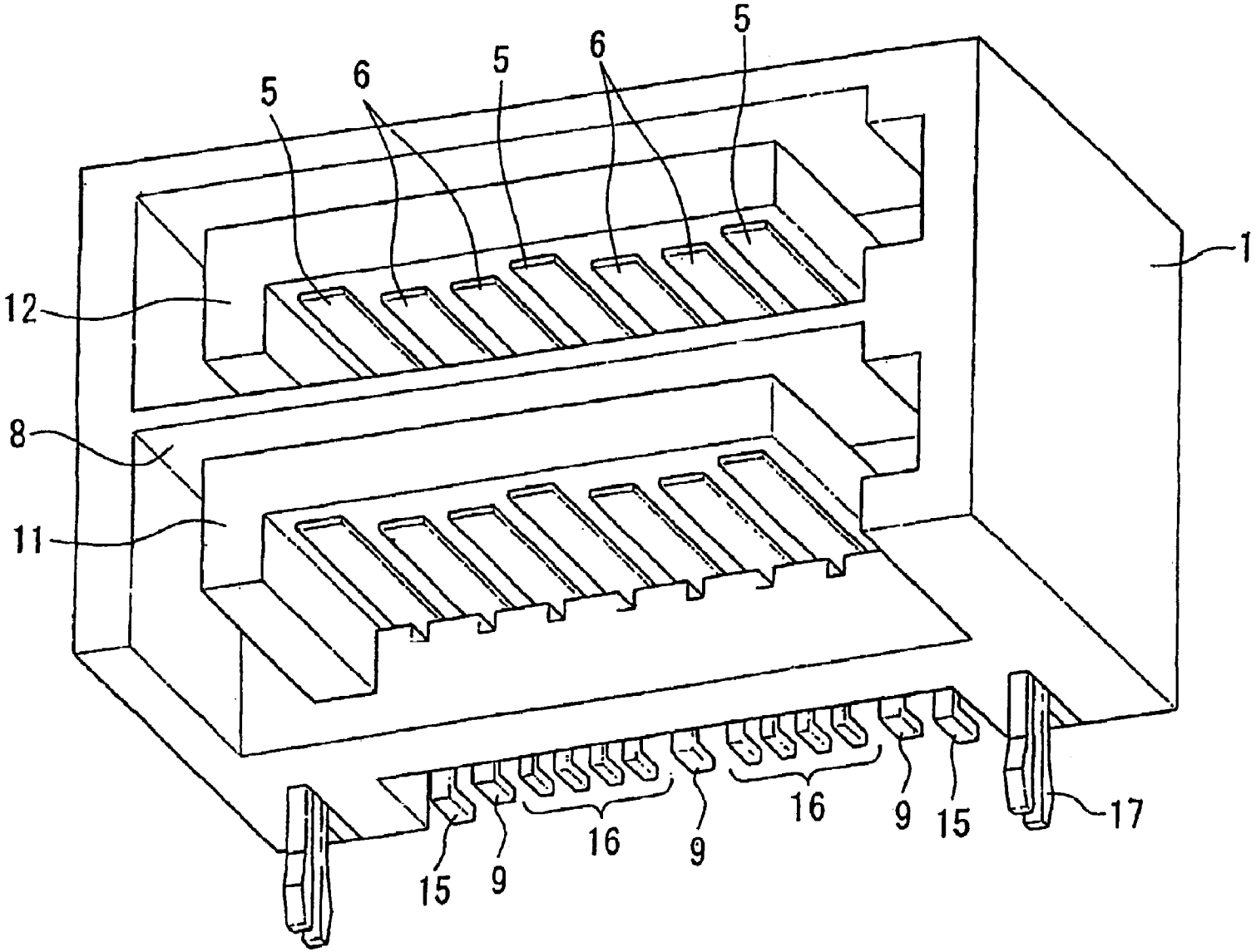
FIG. 1 is a front perspective view of an electric connector according to the present invention.

1 . . . casing
5 . . . electric contact for grounding
6 . . . electric contact for signals
8 . . . boundary region portion
9 . . . leg portion of electric contacts for grounding of the lower level
10 . . . inner wall
11 . . . first guide portion
12 . . . second guide portion
13 . . . recessed portion of casing back surface
14 . . . shield portion
15 . . . leg portion for grounding of shield portion
16 . . . leg portion of electric contact for signals
17 . . . peg
18 . . . electric contact for electric connector mating with electric connector according to the present invention
19 . . . electric contact for electric connector on side of board according to the present invention
20 . . . board

BEST MODE FOR EMBODYING THE INVENTION

Figure 2:
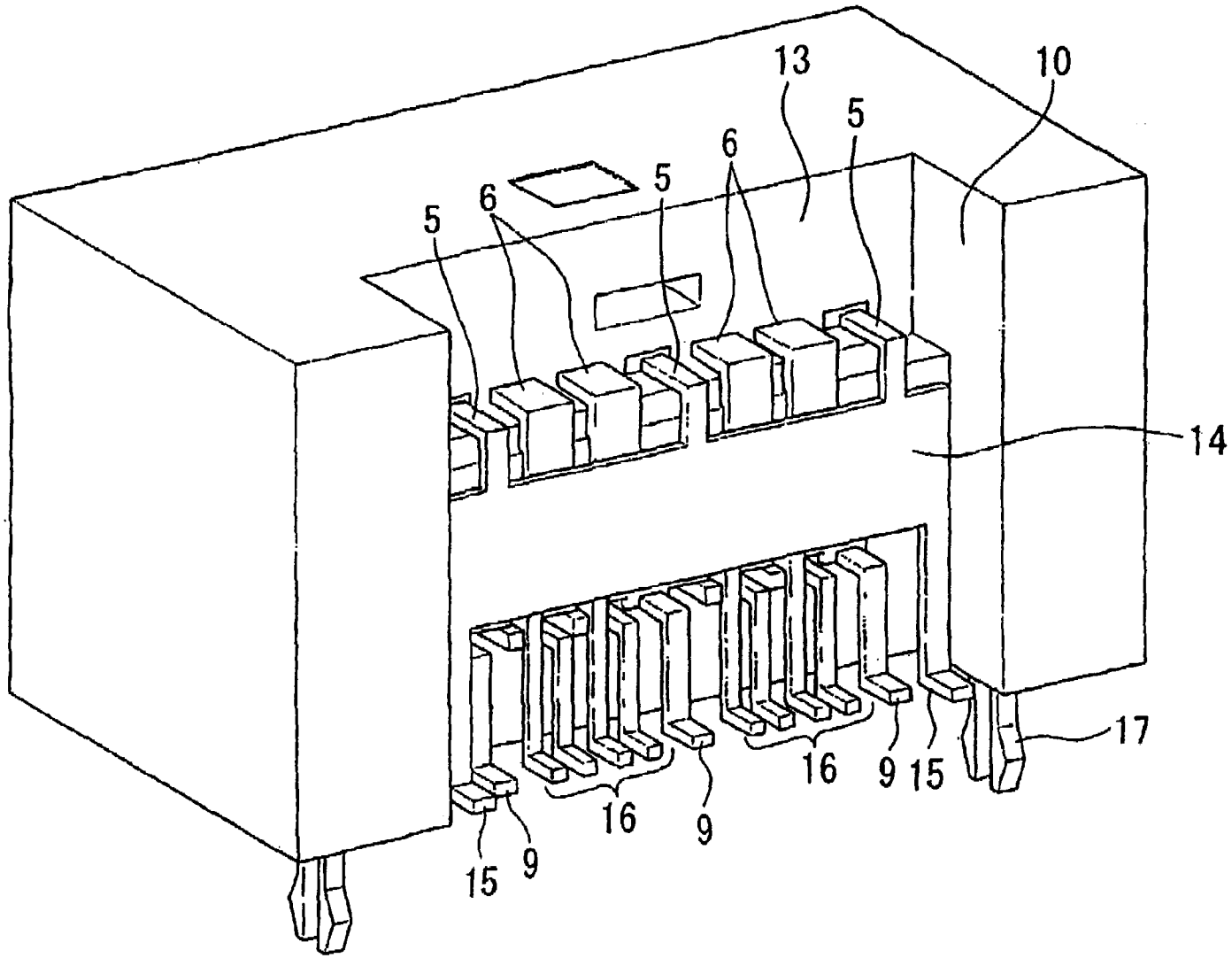
FIG. 2 is a rear perspective view of an electric connector according to the present invention.
Figure 3:
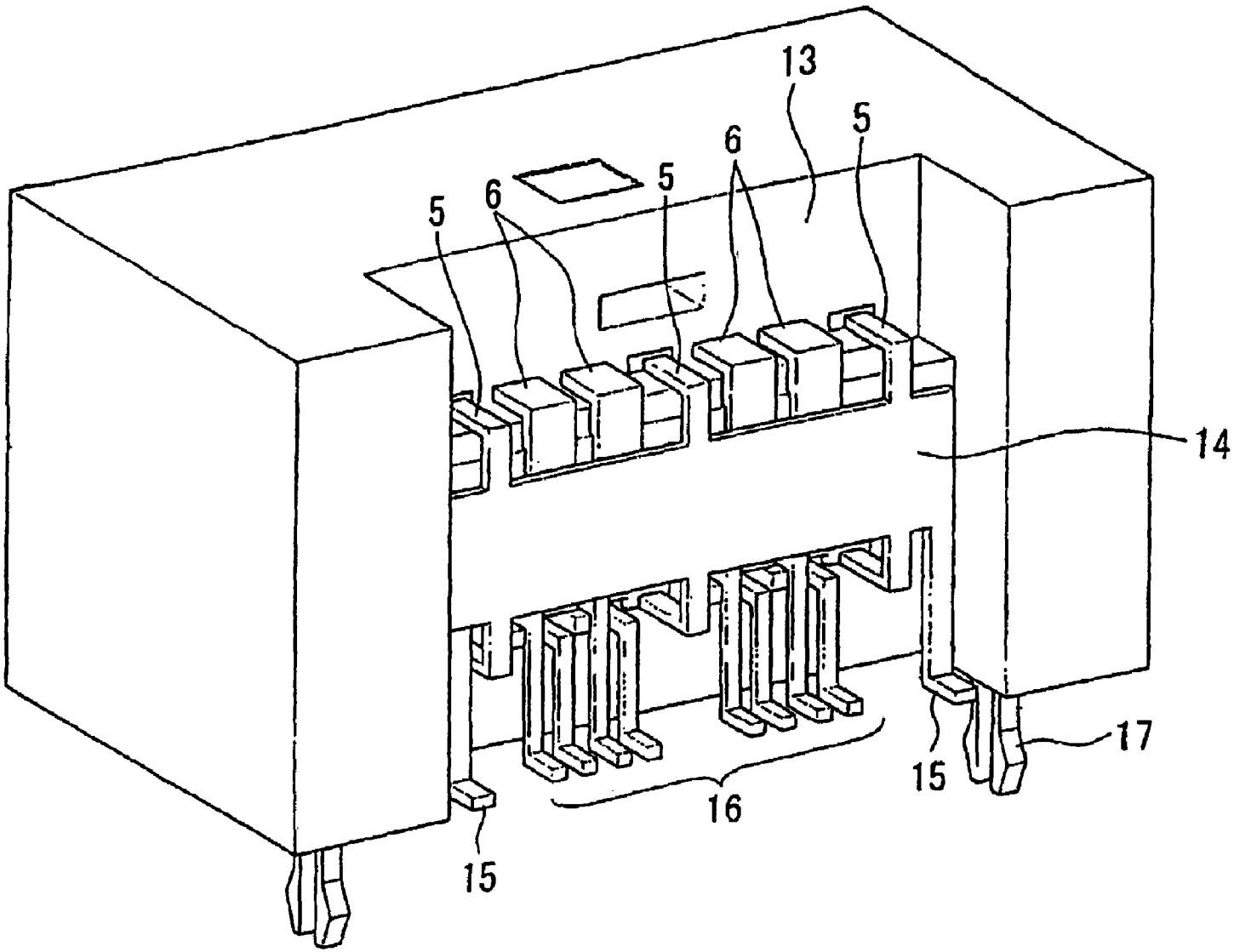
FIG. 3 is a variant example of a rear perspective view of an electric connector according to the present invention.

FIG. 1, FIG. 2, and FIG. 3 show perspective views of a two level type serial ATA standard electric connector.

FIG. 1 is a front perspective view of said electric connector. Said connector is constructed from a casing 1 molded from resin corresponding to the main body of the connector, a guide portion placed therein, and an electric contact row (see FIG. 4) aligned on the surface of the aforementioned guide portion.

The aforementioned casing 1 has an insertion slot side for inserting a mating connector (FIG. 1 front) and a connector back side (FIG. 2 front). On the inside of the casing, at said insertion slot side of FIG. 1, a space is formed that is divided in two by a boundary region portion 8 that extends in the direction of the back surface of the connector, and further, in order to fit with the main body of the paired connector, a guide portion 11 and guide portion 12 are provided. The aforementioned guide portion 11 protrudes from the back surface of the connector in the direction of the insertion slot surface of the aforementioned casing, while maintaining a constant spatial distance from the aforementioned boundary region portion 8. Similarly, the aforementioned guide portion 12 protrudes from the back surface of the connector in the direction of the insertion slot surface while maintaining a constant spatial distance from the casing upper portion and the aforementioned boundary region portion 8.

Figure 4:
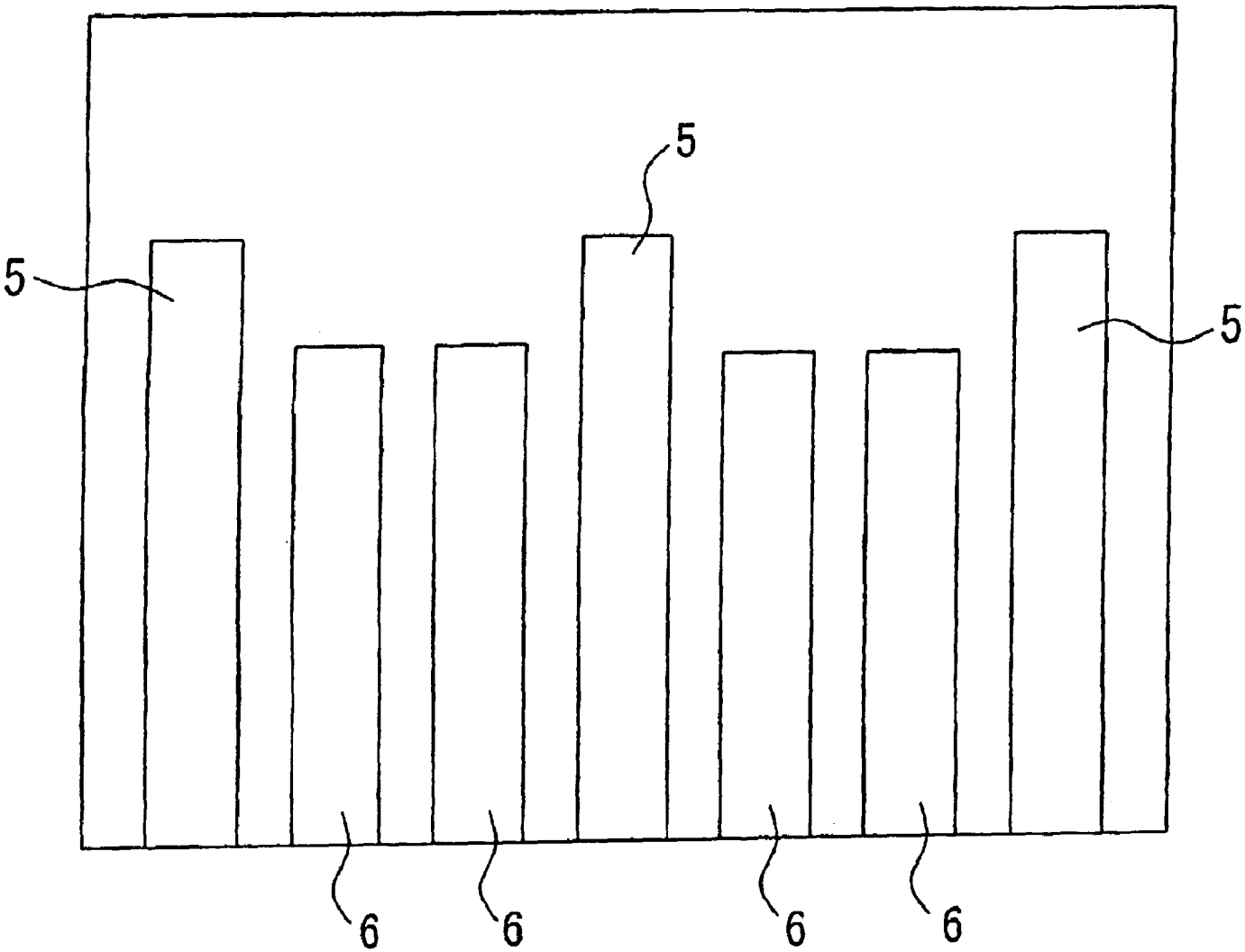
FIG. 4 is a top view of an electric contact row of an electric connector according to the present invention.

The aforementioned electric contact rows are aligned longitudinally in the form of the teeth of a comb on the lower surface of each of the aforementioned guide portions (see FIG. 4).

FIG. 4 is a top view of the electric contact row in each of the levels of said electric connector. The aforementioned alignment of electric contacts is constructed from three electric contacts for grounding 5 and four electric contacts for signals 6, and the aforementioned electric contacts for grounding 5 are aligned so as to sandwich two of the aforementioned electric contacts for signals 6 aligned in succession.

Next, a rear perspective view of said electric connector is shown in FIG. 2, and a variant example thereof is shown in example 3.

In FIG. 2, a recessed portion 13 of the casing is formed on the back surface of said connector casing 1, and each electric contact penetrates through the aforementioned recessed portion 13 in the longitudinal direction of said electric contact, and protrudes in the direction of the casing insertion slot surface. Each of the electric contacts for grounding 5 on the upper level are connected to a shield portion 14 located between each of the array surfaces of the upper level and lower level, that is, each of the first planes, and a leg portion for grounding 15 extends from both ends of said shield portion to the connector bottom surface, that is, a second plane. Additionally, each of the electric contacts for grounding 5 on the lower level and each of the electric contacts for signals 6 on each level extend within the space between the aforementioned recessed portion 13 and the aforementioned shield portion 14 to the aforementioned second plane in a direction perpendicular to the array surfaces of the electric contacts, that is, to the first planes, respectively forming leg portions 9 and leg portions 16. At this time, the width of the leg portions of each of the contacts at portions below the height of the shield portion relative to the second plane is reduced, and the leg portions 9 of the aforementioned electric contacts for grounding are aligned so as to sandwich four leg portions 16 of the aforementioned electric contacts for signals 6 of each level being aligned alternately. Further, in the same plane as the aforementioned second plane, the aforementioned leg portions 9, 15, and 16 have protruding portions in a direction perpendicular to the aforementioned leg portions.

In cases where anchoring is done by inserting pegs 17 into a board 20, the bottom surface of the connector and the surface of the board become even, and the anchoring of the protruding portions of each leg portion 9, 15, and 16, and the printed wiring on the board by soldering and the like becomes easy.

FIG. 3 has an identical structure to FIG. 2 other than the fact that the leg portions 9 of each of the electric contacts for grounding of the lower level are joined to the shield portion 14.

Figure 5:
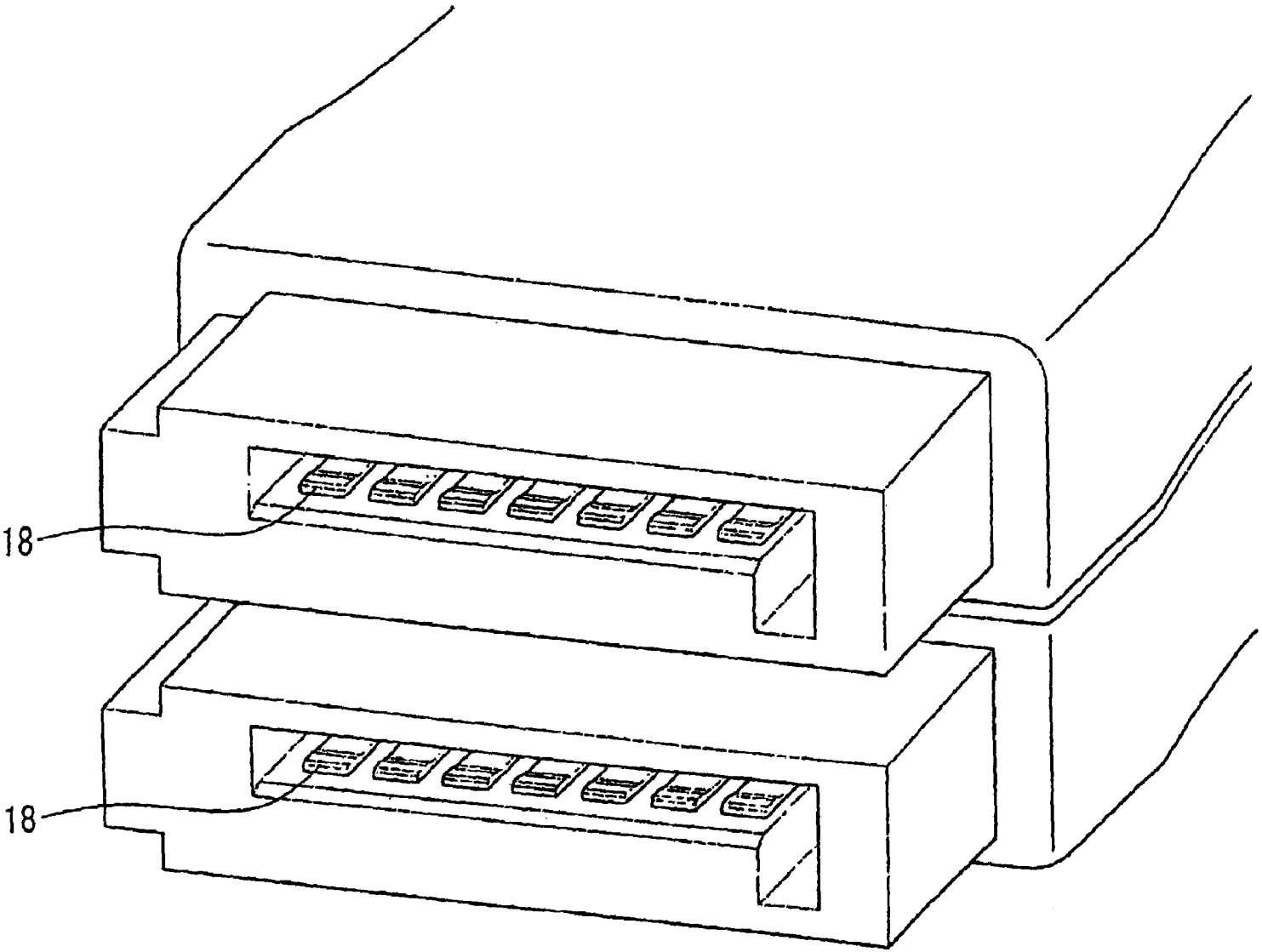
FIG. 5 is an external view of an electric connector that mates with and connects to the electric connector according to the present invention.

FIG. 5 is an external view of an electric connector that mates with and connects to the electric connector of the present invention. Seven electric contacts 18 are located on the bottom surface of each level, and when the electric connectors are connected, contact points are made with the electric contacts of the connector of the present invention. Whereby, a connection is formed with peripheral devices, and the high-speed transfer of signals is possible.

Figure 6:
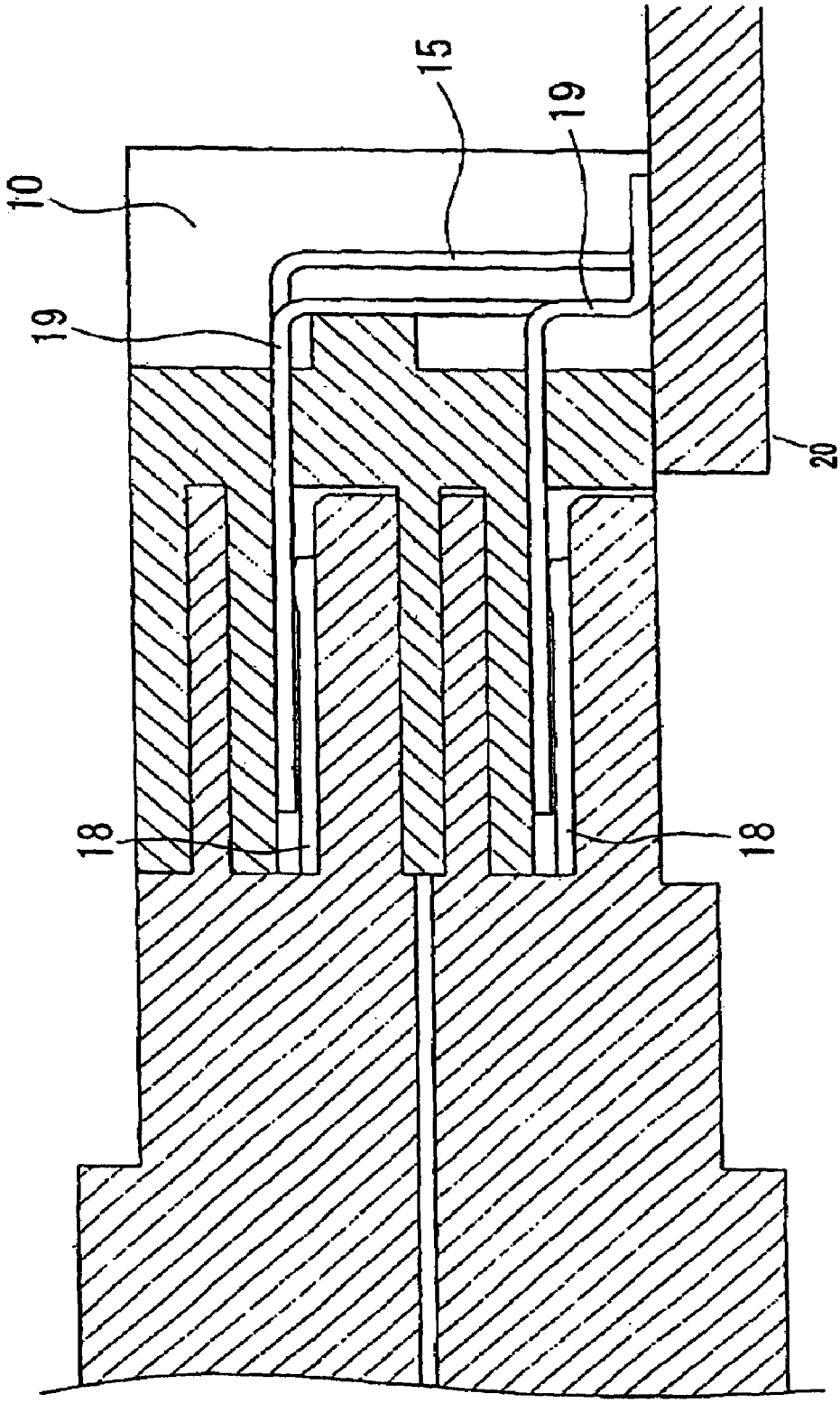
FIG. 6 is a side view of the coupling of an electric connector according to the present invention.

FIG. 6 is a side view of electric connectors in a coupled state. If said connectors are mutually joined, electric contacts 19 of an electric connector connected to the side of a board 20 is put into contact with electric contacts 18 on the side of an electric connector mating with and connecting to it. Additionally, each electric contact, and the leg portions 19, 15 of a shield portion 14 of an electric connector on the side of a board 20, are located within the width of the inner wall 10 of the aforementioned recessed portion 13.

The shape of the connector attached to the board 20, and the shape and location and the like of the aforementioned guide portion are not restricted to the present embodiment, and it is obvious to those skilled in the art that other embodiments are also possible. All connectors which are characterized in that shield portions, according to required characteristics, at least partially cover leg portions of electric contacts for signals, and which have such a structure, are included in the present invention. Therefore, embodiments of the present invention are not restricted to the descriptions given above.

As a result of having measured the impedance of upper level and lower level signal lines using electric connectors according to the present invention, it was confirmed that the error thereof becomes smaller, so it can be said that the impedance error arising from the difference in lengths of the electric contacts for signal lines on the upper level and lower level of an electric connector is improved. Therefore, it is shown that the signal characteristics are improved and an effect of realizing high speed signal transfer is possessed.

The invention claimed is:

1. Multiple level type electric connector characterized by being an electric connector provided with a plurality of levels of rows of electric contacts aligned on a same surface, stacked in a direction perpendicular to the aforementioned surfaces, each electric contact row containing electric contacts for signals and electric contacts for grounding, each electric contact for signals contained in each electric contact row having an end located on a first plane that differs for each level, and a leg portion extending downwards from said first plane and leading to a same second plane, each electric contact for grounding contained in each electric contact row having an end located on a first plane, wherein the electric connector further comprises a shield portion connected to the aforementioned electric contacts for grounding of at least the upper level and a same grounding line on a second plane, and wherein the shield portion at least partially covers at least some of the leg portions of the aforementioned electric contacts for signals.

2. A multiple level type electric connector recited in claim 1, characterized in that the aforementioned electric contact row with a plurality of levels has two levels.

3. A multiple level type electric connector recited in claim 1, characterized in that the aforementioned shield portion does not cover the leg portions of the electric contacts for signals of the lowest level.

4. A multiple level type electric connector recited in claim 1, characterized in that the aforementioned shield portion is located above the leg portions of the electric contacts for signals of the lowest level.

5. A multiple level type electric connector recited in claim 1, characterized in that the shape and material of the aforementioned shield portion are determined so that the impedance of each of the electric contacts for signals are substantially the same.

6. A multiple level type electric connector recited in claim 1, characterized in that the electric contact rows in each of the aforementioned levels are such that an electric contact for grounding is provided for each N (N being an integer greater than or equal to 1) successive electric contacts for signals.

7. A multiple level type electric connector recited in claim 1, provided with a housing capable of housing the aforementioned electric contact row.

8. A multiple level type electric connector recited in claim 1, that is mountable on an electronic circuit board.

* * * * *